US007475692B2

(12) United States Patent
Hartstock et al.

(10) Patent No.: US 7,475,692 B2
(45) Date of Patent: Jan. 13, 2009

(54) APPLICATOR, IN PARTICULAR FOR A LIP COSMETIC

(75) Inventors: Karl Hartstock, Ansbach (DE); Norbert Dumler, Ansbach (DE)

(73) Assignee: Geka Brush GmbH, Bechhofen-Waizendorf (DE)

( * ) Notice: Subject to any disclaimer, the term of this patent is extended or adjusted under 35 U.S.C. 154(b) by 0 days.

(21) Appl. No.: 11/236,852

(22) Filed: Sep. 28, 2005

(65) Prior Publication Data

US 2006/0065282 A1 Mar. 30, 2006

(30) Foreign Application Priority Data

Sep. 28, 2004 (EP) ..... 04023014

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/317, 320; 401/129, 126, 118, 130, 128, 401/119, 122, 286; 403/267
See application file for complete search history.

(56) References Cited

U.S. PATENT DOCUMENTS

| | | | | |
|---|---|---|---|---|
| 2,029,835 | A | 2/1936 | Reichle | |
| 4,147,443 | A * | 4/1979 | Skobel | 403/267 |
| 4,437,477 | A * | 3/1984 | Gueret | 132/320 |
| 4,974,980 | A * | 12/1990 | Gueret | 401/119 |
| 6,033,143 | A | 3/2000 | Gueret | |
| 6,331,085 | B1 * | 12/2001 | Schrepf et al. | 401/128 |
| 6,341,912 | B1 | 1/2002 | Gueret | |
| 6,616,366 | B1 * | 9/2003 | Weihrauch | 401/286 |
| 2003/0034322 | A1 | 2/2003 | Doherty et al. | |

FOREIGN PATENT DOCUMENTS

| | | |
|---|---|---|
| EP | 1 384 417 A2 | 1/2004 |
| GB | 2 094 235 A | 9/1982 |
| WO | WO 00/54623 | 9/2000 |

* cited by examiner

*Primary Examiner*—Robyn Doan
(74) *Attorney, Agent, or Firm*—Browdy and Neimark, P.L.L.C.

(57) ABSTRACT

In an applicator, in particular for a lip cosmetic, comprising a spattle-like base body injected from plastic, it is provided that the base body has a spattle-like form, wherein, starting from the stem towards the outer end, the thickness decreases, in particular tapers progressively curved.

10 Claims, 4 Drawing Sheets

APPLICATOR, IN PARTICULAR FOR A LIP COSMETIC

FIELD OF THE INVENTION

The invention relates to an applicator, in particular for a lip cosmetic, as e.g. a dyed lip creme, comprising a spattle-like base body injection moulded from plastic.

BACKGROUND OF THE INVENTION

So-called lipsticks are known, which do not require a separate applicator because the pencil-like formed cosmetic is comparatively solid and resistant to deformation and thus can be applied to the lips directly after removal of the protective casing.

Increasingly creamy and viscous cosmetics, respectively, have prevailed recently, which are applied from the reservoir by means of an applicator.

Accordingly, such applicators have to fulfill a plurality of functions, namely receiving of liquid in the reservoir, transfer of the liquid from the reservoir to the lips, even and well directed distribution on the lips, tracing of the contours according to the lip contours and putting across a comfortable and monitoring feeling when applying to the lips.

By this use of comparatively liquid cosmetics the demands on the applicator have risen considerably. This is particularly true for applying a colored cosmetic instead of an uncolored lip cosmetic. Whereas, previously, the tracing of the contour was relatively unimportant when applying a transparent, uncolored cosmetic, this aspect has now gained in importance, considerably, because deviations from the lip contour are conspicuous when applying a colored cosmetic.

Though brush-formed applicators have comfortable tactile characteristics for the user, it is difficult to trace more precise contours with such applicators.

Applicators of the generic type are known e.g. from GB 2 094 235 A, US 2003/034322 and U.S. Pat. No. 6,34,912. However, these applicators have the disadvantage that no brush-like laying-on behavior and applying feeling can be reached, and that there is the risk that they have breaks across the longitudinal axis during application which lead to a inhomogeneous application.

SUMMARY OF THE INVENTION

It is an object of the invention to form such applicator such that it has optimal transfer characteristics and enables an even and decorative application of the cosmetic.

This object is achieved by the base body having a thickness decreasing towards the tip such, that, starting from the inner end, the base body tapers almost equally, progressively towards the outer end forming a concave surface.

By this embodiment it is achieved that the applicator is experienced as being soft by the user during application, and that, however, at the same time it is possible to develop a sense for the right application pressure.

In a further embodiment of the invention it may be provided that the base body is provided with recesses.

In the first embodiment the recesses are formed lengthwise and undulated in the cross-sectional view.

Another embodiment provides for the recesses being designed as through holes.

These recesses provide for the reception of a defined amount of a lip cosmetic when pulling the applicator out of the reservoir and for the even distribution of said lip cosmetic on the lips during application.

In a further embodiment of the invention it can be provided that the base body is provided with a connecting socket for fixing it to a stem, wherein the connecting socket can in particular have a snap-in groove for establishing a locking connection with the stem.

Alternatively, the applicator can have a groove which is overlapped by a sleeve-like section of the stem, wherein particularly thermal deformations are brought to the sleeve-like section of the stem in the area of the groove from the outside, which deformations engage with the groove punctiformly thus creating a durable connection.

These through holes can e.g. be circular or longish, oval.

The free outer edge of the applicator can run vertically or transversely to the longitudinal axis of the applicator or is symmetrically or asymmetrically curved. In this way it is particularly possible to form an applicator tip for enabling a particular clean contour tracing.

In a further embodiment of the invention it can be provided that the base body has a surface roughness in the area of 1 to 15 μm.

Pigments can be admixed to the plastic at least in the area of the base body.

Advantageously, the base body is composed of a soft plastic from a thermoplastic elastomer, in particular a thermoplastic urethane, with a shore hardness A of 65 to 80.

In a particularly advantageous embodiment it is provided that the applicator comprises a harder inner stem-sided connecting socket 3 and a softer outer plastic base body 2, 2', 2", wherein the hardness of the base body can be within the above mentioned range.

In particular, the stem-sided connection socket can consist of the harder component.

Thus, the harder socket extends into the softer component formed by the base body.

In this embodiment, the soft component can have a conical transition area towards the stem-sided hard component and the stem socket, respectively.

Advantageously, the stem socket has a through hole which is extrusion-coated and intermingled from the soft component thus providing for a solid connection of the hard and the soft component during axial stress. This results by forming the base body 2, 2', 2" as a unit over the socket 3 as shown in FIGS. 4 and 5 so that a portion of the base body extends through the length of through hole 10 so as to fix and interlock the base body and socket together.

Thereby, the hard component provides for the mechanical stability whereas the outer soft component enables the desired brush-like applying characteristics.

The invention will become apparent from the ensuing description of the exemplary embodiments, taken in conjunction with the drawing.

DESCRIPTION OF THE PREFERRED EMBODIMENT

Figure 1:
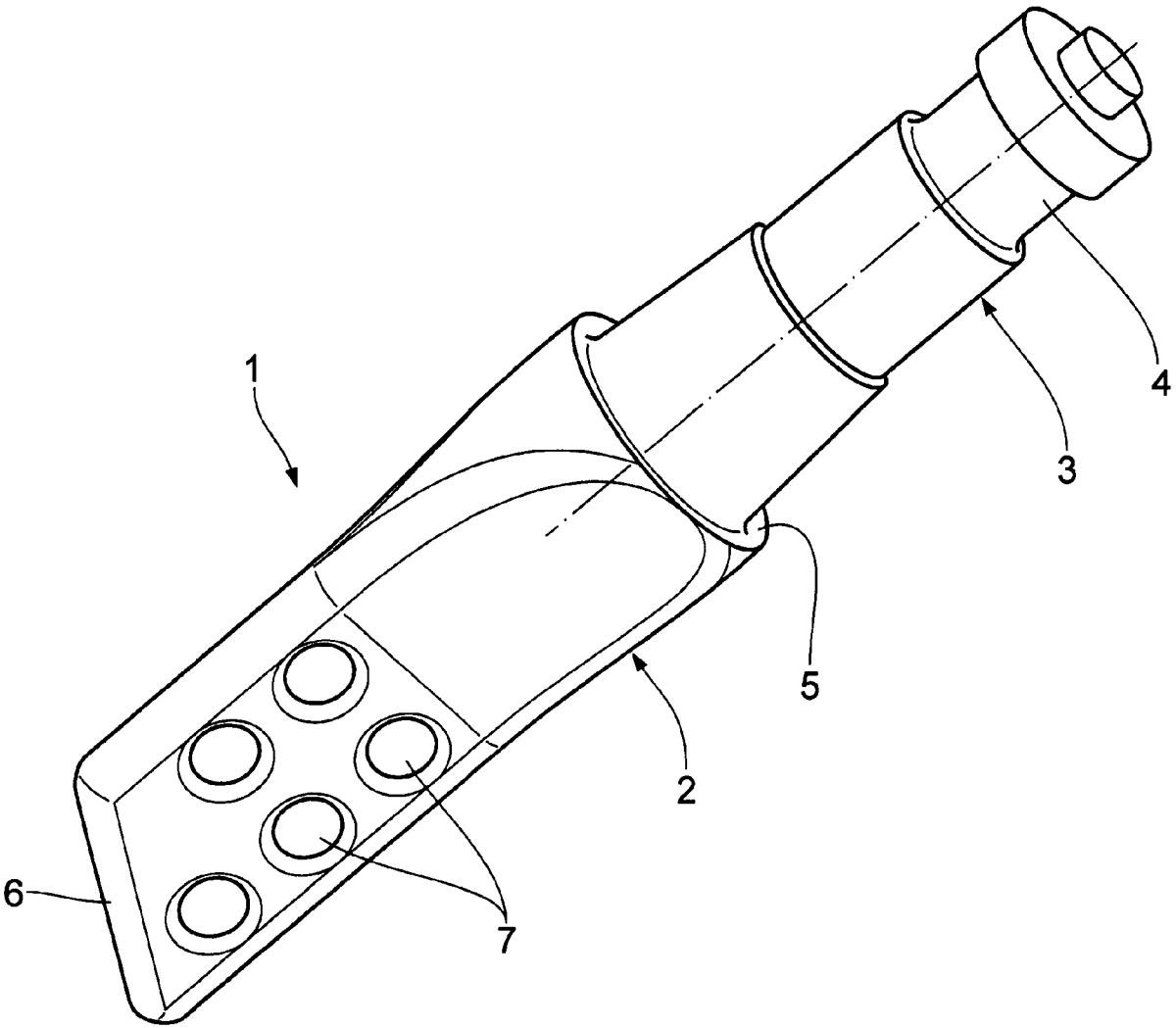
FIGS. 1 to 3 are three perspective views of different embodiments.

An applicator 1 shown in FIG. 1 comprises a base body 2, which is injection moulded in one piece with a connecting socket 3.

The connecting socket 3 is provided with a snap-in groove for snap-engagement with a stem not shown in the drawing.

The base body 2 has a circular base plane 5 in the transition area to the connecting socket 3, from which two concave limiting areas extend so that the base body 2 has a spattle-like basic shape comprising an inclined outer edge 6.

The base body 2 is formed such that the thickness tapers progressively starting from the stem-sided connecting socket 3 towards the free outer edge, i.e. the edge 6. Thus, starting from a circular and rounded cross-sectional configuration, the applying area increases towards the front end. In doing so, a brush-like feeling is put across to the user during application, wherein an excellent contour tracing becomes possible, simultaneously.

This inclined outer edge may alternatively run vertically to the longitudinal direction. It can be rounded, triangularly shaped in a cross-sectional view with different lip angles or also rectangular. Depending on the geometry different tracing possibilities are achieved.

The base body 2 is provided with circular through holes 7, which receive and retain the cosmetic during pulling-out of the reservoir due to the surface tension and dispense it during application in a well-defined way.

Figure 2:
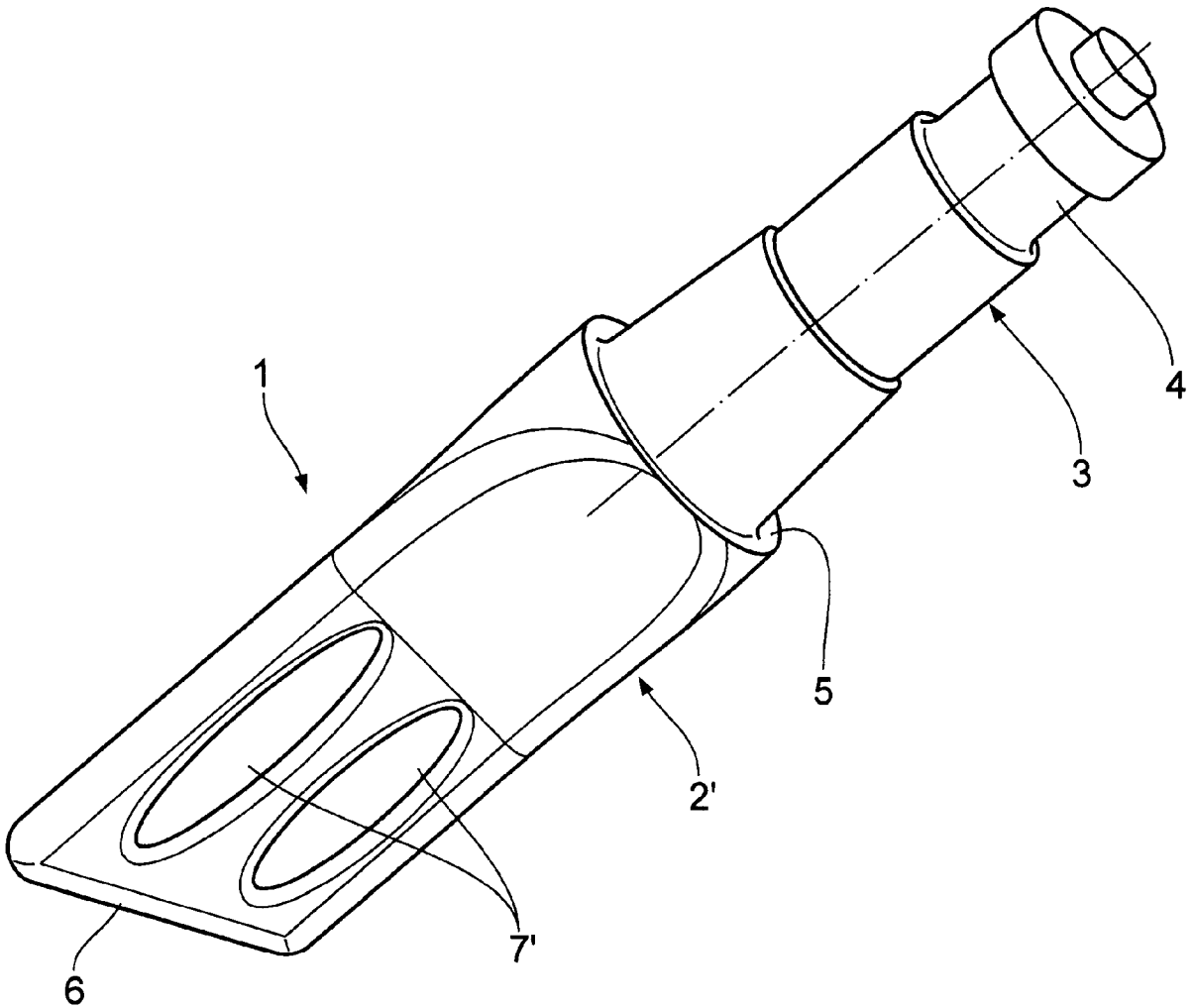

In the embodiment according to FIG. 2 the base body 2' has oval-longish through-holes 7'. In other respects the embodiment corresponds to the embodiment of FIG. 1.

Figure 3:
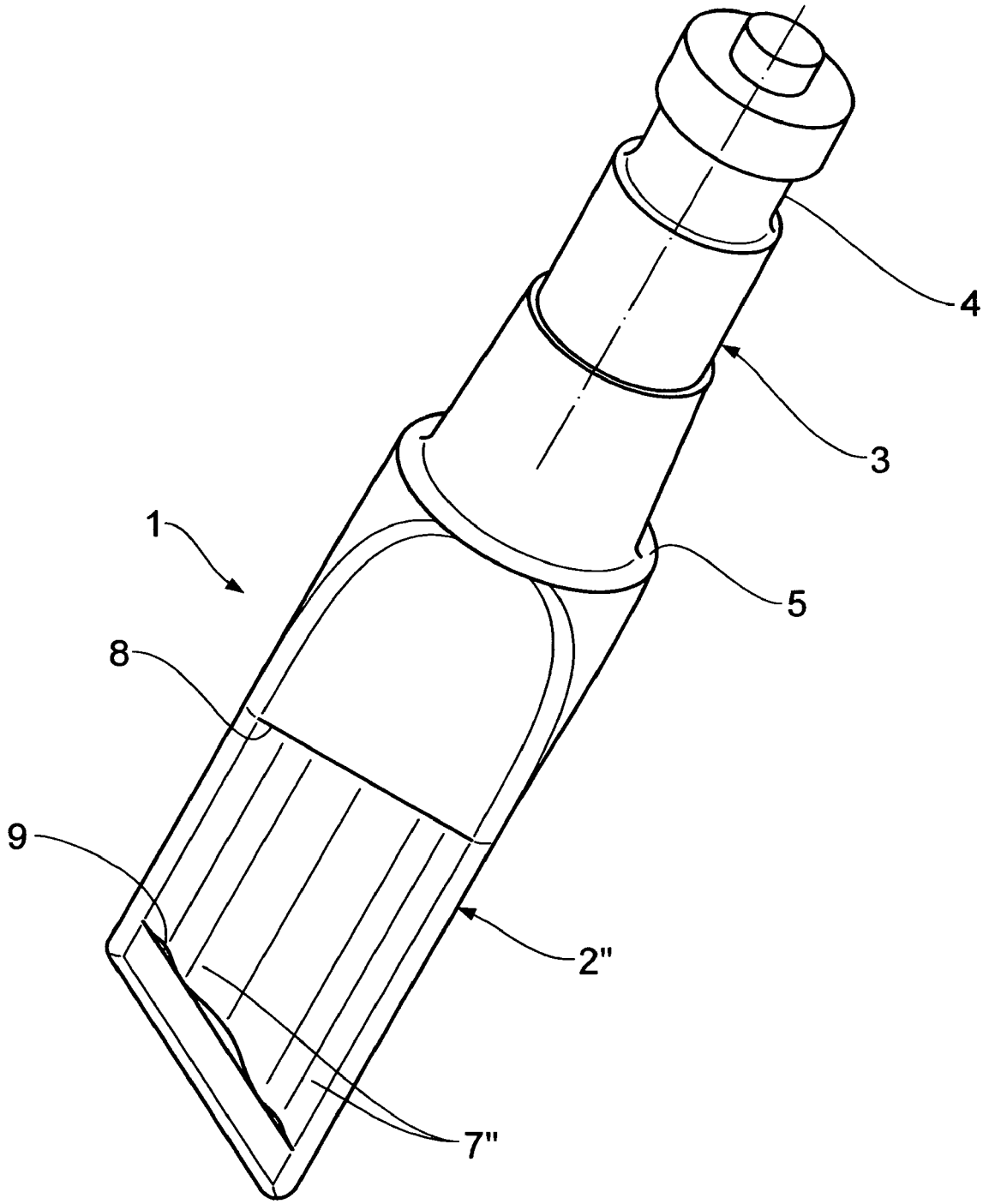

No through holes, but only recesses 7" running in the longitudinal direction are provided in the base body 2" in to the embodiment of FIG. 3, which recesses extend between two inclined limiting areas 8 and 9, respectively.

Differing from the embodiments described above either very few, greater through holes or a considerable plurality of through holes, e.g. up to 1500 can be provided.

Figure 4:
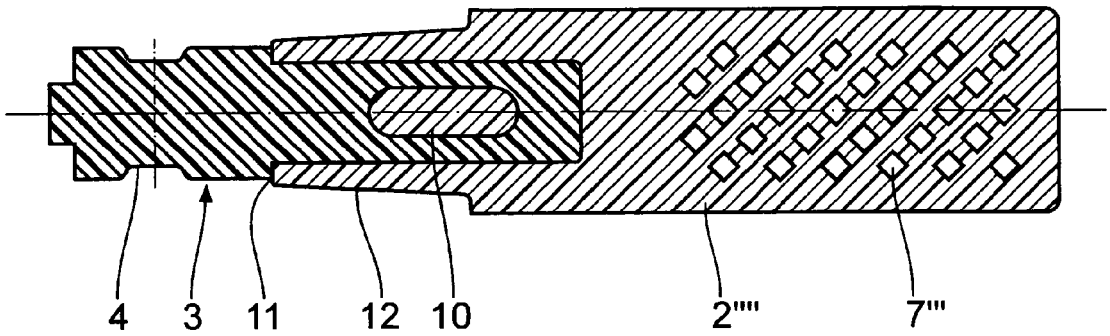
FIGS. 4 to 5 are respectively a plan sectional view and an elevation sectional view of another embodiment turned by 90°.
Figure 5:
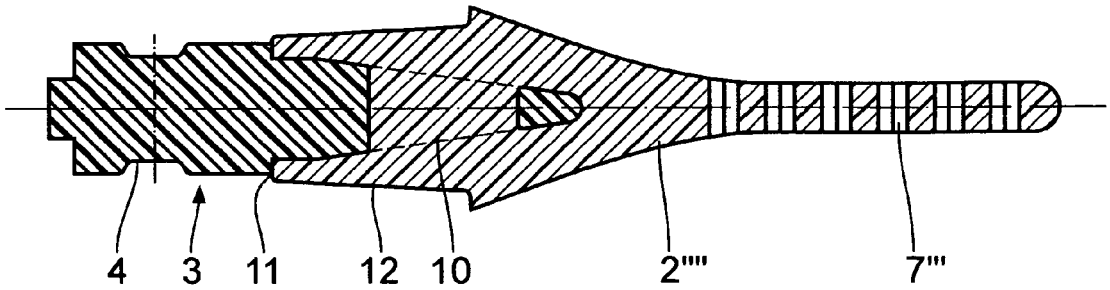

In the embodiment according to FIGS. 4 and 5 the connecting socket 3 is injected from a harder plastic and the base body 2"" is injected from a softer plastic with a shore hardness of 65 to 80. The through holes 7''' penetrate the base body 2"" completely, as can be seen from FIG. 5.

AS noted in the Summary of the Invention above, the connecting socket 3 has recesses 10 which are completely extrusion-coated and intermingled with the base body (2, 2', 2") so as to interlock the socket 3 and base body together.

The connecting socket 3 has a grading 11 towards the inside and the base body 2"" tapers in a conical section 12 towards the grading 11.

What is claimed is:

1. An applicator for a lip cosmetic, comprising a spattle-shaped base body injected from plastic, wherein the base body (2, 2', 2") has a thickness decreasing towards a tip such that starting from an inner end, the base body tapers almost equally, progressively towards an outer end forming a concave surface;

wherein the base body (2, 2', 2") is fixed to a stem-sided connecting socket (3) for fixing to a stem;

wherein the stem-sided connecting socket (3) is formed as a unit and has a through hole (10), wherein the base body (2, 2', 2") is formed as a unit engaged around an outer circumference of the connecting socket and has a portion thereof extending by injection through the entire length of the through hole to fix and interlock the base body and the stem-sided connecting socket together, wherein the base body is formed from a plastic material softer than a plastic material forming the stem-sided connecting socket, and wherein the softer plastic material has a shore hardness A of 65 to 80.

2. Applicator according to claim 1, wherein the base body (2, 2', 2") is provided with recesses (7, 7', 7").

3. Applicator according to claim 2, wherein the recesses (7, 7') are formed as through holes.

4. Applicator according to claim 3, wherein a plurality of circular through holes (7) is provided.

5. Applicator according to claim 3, wherein the through holes (7') are oval.

6. Application according to claim 1, wherein a free outer edge (6) of the applicator runs vertically or transversely to the longitudinal axis of the applicator or is symmetrically or asymmetrically curved.

7. Applicator according to claim 1, wherein the base body (2, 2', 2") has a surface roughness of 1 to 15 μm.

8. Applicator according to claim 1, wherein pigments are admixed at least in the area of the base body (2, 2', 2").

9. Applicator according to claim 1, wherein the softer plastic material of the base body (2, 2', 2") is a thermoplastic urethane with a shore hardness A of 65 to 80.

10. Applicator according to claim 1, wherein the base body (2, 2', 2") has a conical transition area towards the stem-sided connecting socket.

* * * * *

UNITED STATES PATENT AND TRADEMARK OFFICE

CERTIFICATE OF CORRECTION

PATENT NO. : 7,475,692 B2
APPLICATION NO. : 11/236852
DATED : January 13, 2009
INVENTOR(S) : Karl Hartstock It is certified that error appears in the above-identified patent and that said Letters Patent is hereby corrected as shown below:

On the Title page, Item (30)
Foreign Application Priority Data, delete "September 28, 2004" and insert --October 8, 2004--.

Signed and Sealed this

Sixteenth Day of November, 2010

David J. Kappos

David J. Kappos
*Director of the United States Patent and Trademark Office*